US010124943B2

(12) United States Patent
Paredes et al.

(10) Patent No.: US 10,124,943 B2
(45) Date of Patent: Nov. 13, 2018

(54) DISPENSING CARTON FOR A REFRIGERATOR DOOR

(71) Applicant: Owens-Brockway Glass Container Inc., Perrysburg, OH (US)

(72) Inventors: Raul M Paredes, Perrysburg, OH (US); Douglas Laib, Perrysburg, OH (US); David J. Bohman, Cincinnati, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 153 days.

(21) Appl. No.: 14/061,451

(22) Filed: Oct. 23, 2013

(65) Prior Publication Data

US 2015/0083625 A1 Mar. 26, 2015

Related U.S. Application Data

(63) Continuation-in-part of application No. 14/035,212, filed on Sep. 24, 2013, now abandoned.

(51) Int. Cl.
*B65D 71/34* (2006.01)
*B65D 5/42* (2006.01)
(Continued)

(52) U.S. Cl.
CPC ..... *B65D 71/36* (2013.01); *B65D 2571/0066* (2013.01); *B65D 2571/00141* (2013.01); *B65D 2571/00456* (2013.01); *B65D 2571/00623* (2013.01); *B65D 2571/00728* (2013.01); *B65D 2571/00827* (2013.01)

(58) Field of Classification Search
USPC ..... 229/122, 237, 242, 240; 206/427, 459.5
See application file for complete search history.

(56) References Cited

U.S. PATENT DOCUMENTS 3,127,991 A 4/1964 Burnett
3,894,681 A 7/1975 Arneson et al.
(Continued)

FOREIGN PATENT DOCUMENTS

DE 202012003309 6/2012
EP 1659069 A2 5/2006
(Continued)

OTHER PUBLICATIONS

International Search Report and Written Opinion, Int. Serial No. PCT/US2014/054063, Int. Filing Date: Sep. 4, 2014, Applicant: Owens-Brockway Glass Container Inc., dated Mar. 16, 2015.

*Primary Examiner* — Christopher Demeree

(57) ABSTRACT

An enclosed carton for housing and dispensing a plurality of containers has front and back panels, side panels, and top and bottom end panels connected to the front and back panels and the side panels to form a closed structure with the containers extending height-wise between the side panels. The containers are arranged in at least one row between the front and back panels and are stacked between the bottom and top end panels. The front panel has a plurality of access panels removably connected to the front panel and to each other such that, with said carton positioned on the bottom end panel and the containers oriented horizontally, the access panels can be removed in succession as the containers are removed from the carton to provide access to the remaining containers.

24 Claims, 3 Drawing Sheets

(51) Int. Cl.
*B65D 5/54* (2006.01)
*B65D 71/36* (2006.01)

(56) References Cited

U.S. PATENT DOCUMENTS

| | | | | |
|---|---|---|---|---|
| 4,004,691 | A * | 1/1977 | Wihksne | 206/459.1 |
| 4,417,661 | A | 11/1983 | Roccaforte | |
| 5,072,876 | A | 12/1991 | Wllson | |
| 5,236,084 | A | 8/1993 | Evers | |
| 5,427,242 | A | 6/1995 | Oliff et al. | |
| 5,697,549 | A | 12/1997 | Yocum | |
| 5,836,451 | A | 11/1998 | Dixon | |
| 5,878,947 | A | 3/1999 | Hoy et al. | |
| 6,019,276 | A | 2/2000 | Auclair | |
| 6,027,018 | A * | 2/2000 | Yocum | 229/400 |
| D436,859 | S | 1/2001 | Botsford et al. | |
| 6,283,293 | B1 | 9/2001 | Lingamfelter | |
| 6,386,369 | B2 | 5/2002 | Yuhas et al. | |
| 6,435,351 | B1 | 8/2002 | Gibb | |
| 6,478,219 | B1 | 11/2002 | Holley, Jr. | |
| 6,550,615 | B2 | 4/2003 | Lingamfelter | |
| 6,578,736 | B2 | 6/2003 | Spivey | |
| 6,631,803 | B2 | 10/2003 | Rhodes et al. | |
| 6,715,639 | B2 | 4/2004 | Spivey | |
| 6,866,185 | B2 | 3/2005 | Harrelseon | |
| 6,869,009 | B2 | 3/2005 | Sutherland et al. | |
| 6,918,487 | B2 | 7/2005 | Harrelson | |
| 6,929,172 | B2 | 8/2005 | Bates et al. | |
| 6,974,072 | B2 | 12/2005 | Harrelson | |
| 6,981,631 | B2 | 1/2006 | Fogle et al. | |
| 6,997,316 | B2 | 2/2006 | Sutherland | |
| 7,000,803 | B2 | 2/2006 | Miller | |
| 7,000,824 | B2 | 2/2006 | Saulas | |
| 7,048,817 | B1 | 5/2006 | Hammond | |
| 7,059,494 | B2 | 6/2006 | Harrelson et al. | |
| 7,086,578 | B2 | 8/2006 | Tallevi et al. | |
| 7,100,798 | B2 | 9/2006 | Spivey | |
| 7,134,593 | B2 | 11/2006 | Harrelson | |
| 7,159,759 | B2 | 1/2007 | Sutherland | |
| 7,175,047 | B2 | 2/2007 | Spivey | |
| 7,237,674 | B2 | 7/2007 | Auclair | |
| 7,314,551 | B2 | 1/2008 | Frey et al. | |
| 7,328,798 | B2 | 2/2008 | Auclair et al. | |
| 7,331,505 | B2 | 2/2008 | Holley, Jr. | |
| 7,337,942 | B2 | 3/2008 | Wang | |
| 7,367,453 | B2 | 5/2008 | Sutherland | |
| 7,380,701 | B2 | 6/2008 | Fogle et al. | |
| 7,467,713 | B2 | 12/2008 | Harrelson | |
| 7,478,743 | B2 | 1/2009 | Holley, Jr. | |
| 7,523,842 | B2 | 4/2009 | Spivey | |
| 7,614,497 | B2 | 11/2009 | Spivey, Sr. | |
| 7,673,789 | B2 | 3/2010 | DeBusk et al. | |
| 7,703,665 | B2 | 4/2010 | McGowan | |
| 7,832,621 | B2 | 11/2010 | Smalley | |
| 7,909,235 | B2 | 3/2011 | Holley, Jr. | |
| 7,918,384 | B2 | 4/2011 | Gomes et al. | |
| 7,918,385 | B2 | 4/2011 | Ho Fung et al. | |
| 7,922,070 | B2 | 4/2011 | Auclair | |
| 7,946,451 | B2 | 5/2011 | Spivey | |
| 7,966,789 | B2 | 6/2011 | Hand et al. | |
| 8,061,587 | B2 | 11/2011 | Blin | |
| 8,118,212 | B2 | 2/2012 | Miller | |
| 8,123,072 | B2 | 2/2012 | Spivey | |
| 8,127,924 | B2 | 3/2012 | Harrelson | |
| 8,162,206 | B2 | 4/2012 | Harrelson | |
| 8,167,194 | B2 | 5/2012 | DeBusk et al. | |
| 8,216,118 | B2 | 7/2012 | Dunn | |
| 8,220,702 | B2 | 7/2012 | DeBusk et al. | |
| 8,281,979 | B1 | 10/2012 | Pfanstiehl | |
| 8,302,811 | B2 | 11/2012 | Spivey | |
| 9,162,793 | B2 * | 10/2015 | Stewart | B65D 5/724 |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185527 | A1 | 12/2002 | Bates | |
| 2003/0141353 | A1 | 7/2003 | Wilson | |
| 2003/0178335 | A1 | 9/2003 | Ichikawa et al. | |
| 2003/0192907 | A1 | 10/2003 | Bates | |
| 2004/0089671 | A1 | 5/2004 | Miller | |
| 2004/0099558 | A1 | 5/2004 | Oliff et al. | |
| 2005/0085364 | A1 | 4/2005 | Spivey, Sr. | |
| 2005/0189405 | A1 | 9/2005 | Gomes et al. | |
| 2010/0206944 | A1 | 8/2010 | Bates et al. | |
| 2011/0049227 | A1 | 3/2011 | Gretzinger et al. | |
| 2012/0145775 | A1 | 6/2012 | Miller | |
| 2012/0205273 | A1 | 8/2012 | Harrelson | |

FOREIGN PATENT DOCUMENTS

| | | | | |
|---|---|---|---|---|
| WO | WO 2005/080218 | A1 | 9/2005 | |
| WO | WO 2006/050316 | A1 | 5/2006 | |
| WO | WO 2006105517 | A1 * | 10/2006 | B65D 71/36 |
| WO | WO 2007/089282 | A2 | 8/2007 | |
| WO | WO 2007/101242 | A1 | 9/2007 | |

* cited by examiner

DISPENSING CARTON FOR A REFRIGERATOR DOOR

This application claims the priority of and is a continuation-in-part of application Ser. No. 14/035,212 filed Sep. 24, 2013, the contents of which are incorporated herein by reference.

The present disclosure is directed to a secondary packaging carton for beverage containers and, more particularly, to a dispensing carton that that may be stored in a refrigerator door.

BACKGROUND AND SUMMARY OF THE DISCLOSURE

A general object of the present disclosure, in accordance with one aspect of the disclosure, is to provide a dispensing carton for beverage containers that may be stored in a refrigerator door, and may provide easier access to containers by providing an access opening that is closer to the containers in the lower portion of the carton.

The present disclosure embodies a number of aspects that can be implemented separately from or in combination with each other.

In accordance with another aspect of the disclosure, there is provided a dispensing carton for beverage containers having a plurality of tear-out access panels on the carton that are serially removable to provide access to the containers no matter how many containers remain in the carton.

In accordance with another aspect of the disclosure, there is provided a dispensing carton for beverage containers in which the last of the serially removable panels displays an internally printed coupon.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION

Figures 1, 2:
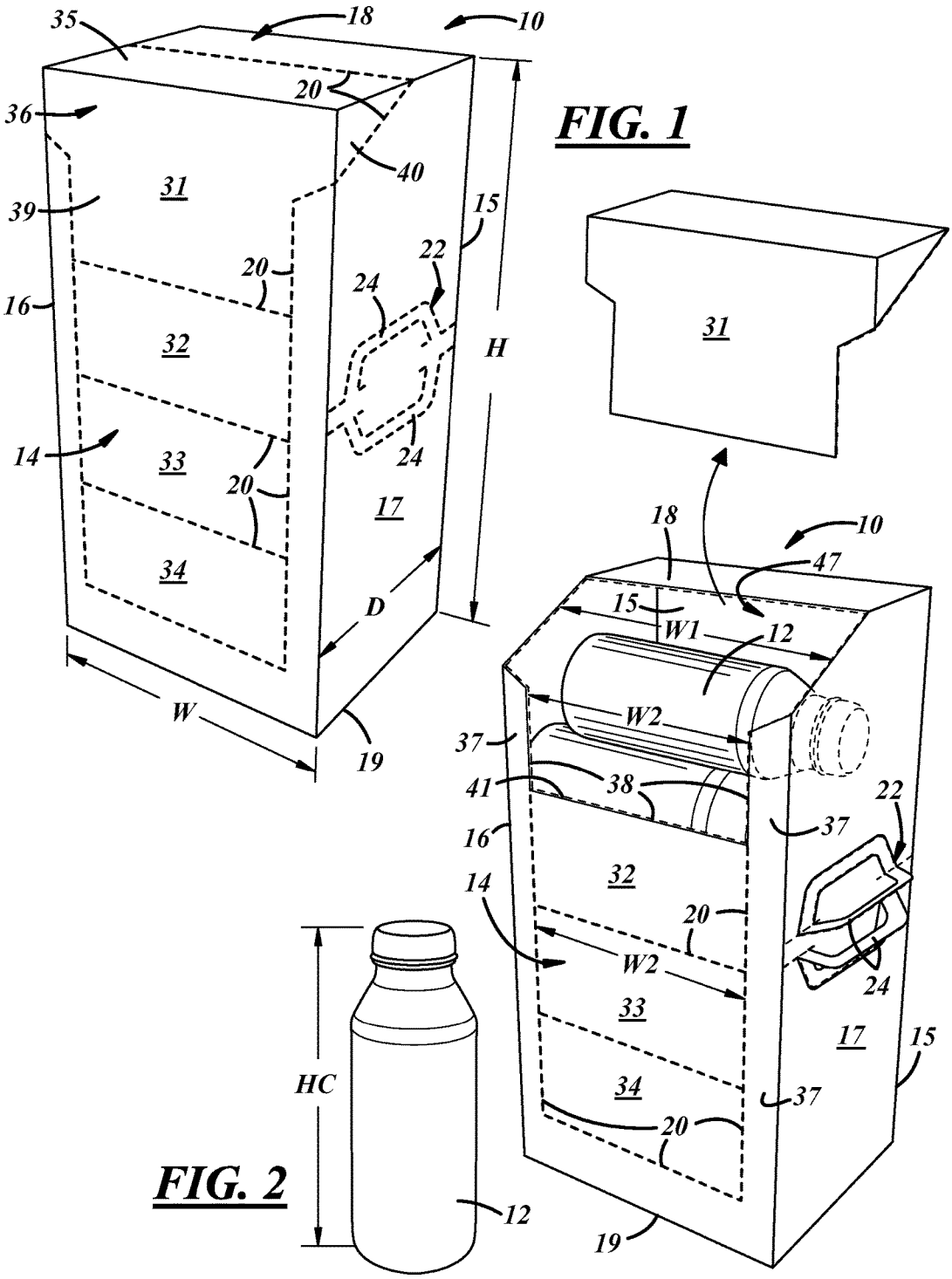
FIG. 1 is a perspective view of a dispensing carton in accordance with an illustrative embodiment of the present disclosure.
FIG. 2 is a perspective view of the dispensing carton of FIG. 1 with a first tear-out access panel being torn off.
Figure 3:
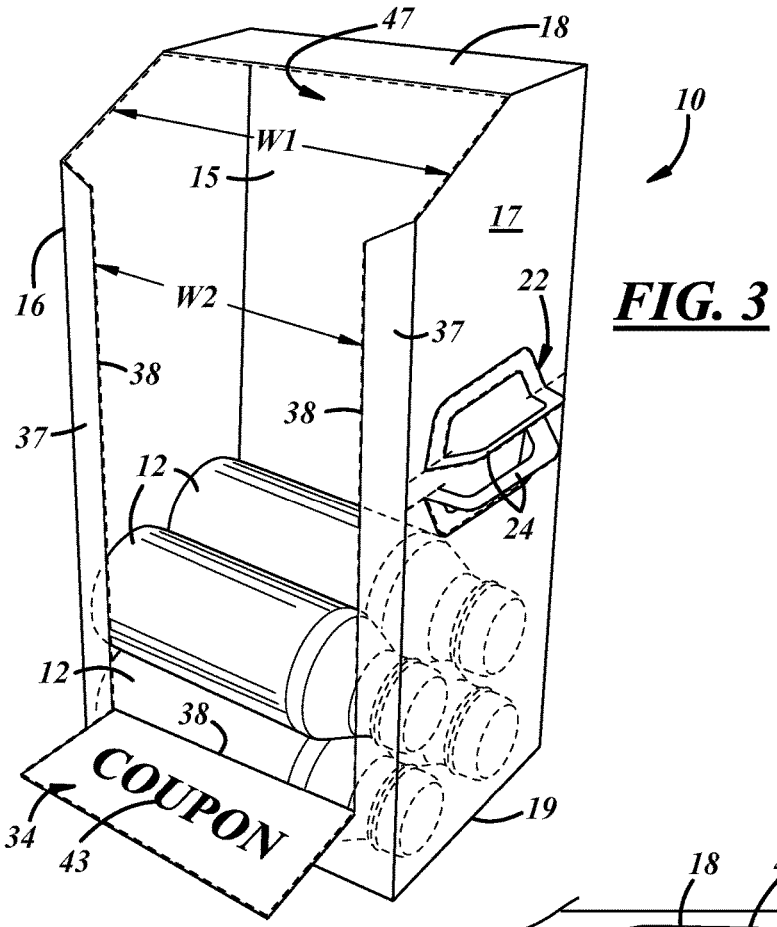
FIG. 3 is a perspective view of the dispensing carton of FIG. 1 with all of the tear-out access panels being torn off
Figure 4:
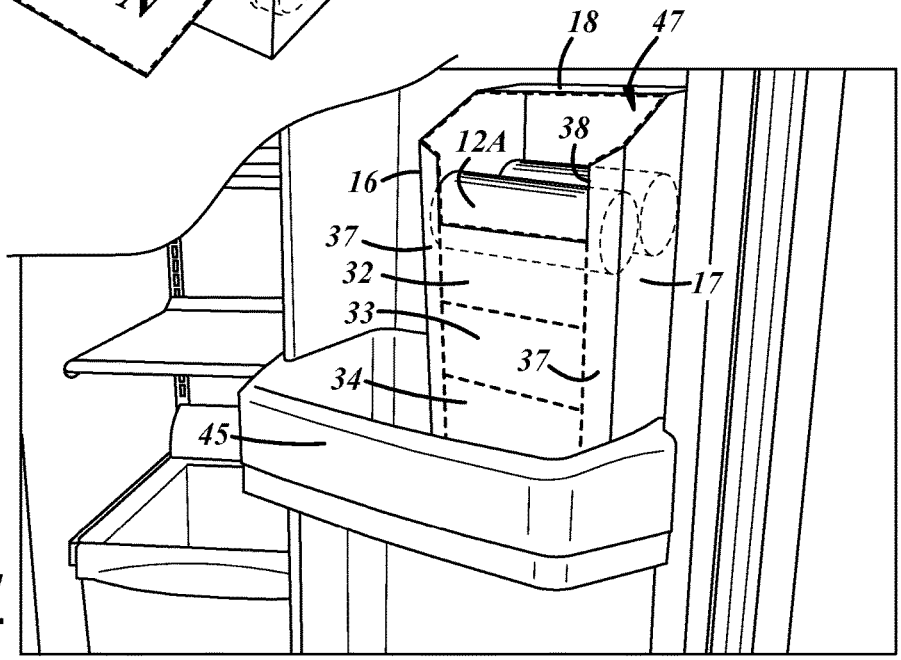
FIG. 4 is an illustrative view showing the dispensing carton as shown in FIG. 2 positioned on a door shelf of a refrigerator.

FIG. 1 illustrates a secondary package in the form of a carton generally designated by the reference numeral 10 for marketing containers 12, best seen in FIGS. 2-4, including particularly beverage bottles and cans which may be generally cylindrical. The carton 10 is a closed rectangular structure, and has opposed front and back panels 14 and 15, respectively, opposed side panels 16 and 17, and opposed top and bottom end panels 18 and 19, respectively. The containers 12 may be positioned within the carton 10 so that they extend height-wise between the two side panels 16 and 17, and are arranged in one or more rows between the front and back panels 14 and 15, respectively. The carton has a handle 22 that is attached to the side panel 17. The handle 22 may alternately be attached to the side panel 16, or two handles may be attached to the carton 10, one to the side panel 16 and one to the side panel 17. Handles may also be attached to the top and bottom end panels 18 and 19, respectively. The handle 22 has two mirror image handle portions 24 and a mounting plate 26 for attaching the handle 22 to the side panel 17. Other handle configurations may be used. An adhesive or other fastening device may be used to attach the mounting plate 26 to the side panel 17. The handle portions 24 may be folded flat against the side panel 17 or extended from the folded position for transporting the carton 10 from the place of purchase. With the handle portions 24 folded flat against the side panel 17, the cartons may be placed in a stacking position on top of one another for stocking and sales purposes with the cartons 10 resting on the side panel 16 that is opposite the handle 22. With the cartons in the stacking position, the containers 12 are upright and stable within the carton 10, with each container 12 resting on its base on the inside surface of the side panel 16.

The carton 10 has a width W measured between the side panels 16 and 17 equal to the height HC of one container 12 as shown in FIG. 2, a depth D measured between the front and back panels 14 and 15, respectively, equal to the combined diameters of the number of containers 12 in each horizontal row of containers 12, and a height H measured between the top and bottom end panels 18 and 19, respectively, equal to the combined diameters of as many containers 12 as desired. In the particular embodiment shown, the carton 10 has a depth D equal to the combined diameter of two containers 12, and a height H equal to the combined diameter of five containers, resulting in a carton that holds ten containers. The carton 10 may have a depth and height dimension equal to a greater or lesser number of containers 12 as desired. The carton 10 is specifically dimensioned to be received on a shelf of a refrigerator door with the carton 10 resting on the bottom end panel 19 as illustrated in FIG. 4.

The carton 10 has weakenings 20 to form a plurality of removable tear-out access panels 31-34 that are connected to the carton 10 and to one another. The weakenings 20 may be formed in the carton material, for instance, by pre-scoring, perforations, thinning, and the like. The tear out access panels 31-34 can be removed in sequence as containers 12 are removed from the carton 10 to provide easier access to the containers that are remaining in the carton 10. A first removable tear-out access panel 31 includes a top portion 35 of the top end panel 18 of the carton 10, and a front portion 36 of the front panel 14 of the carton 10. The front portion 36 has a lower portion 39 that extends across less than the full width of the front panel 14. The first removable tear out access panel 31 may also include a corner portion 40 of the side panels 16 and 17 as shown.

FIG. 2 shows the containers 12 in the form of a bottle having a height HC. The first tear-out access panel 31 extends across the full width of the top end panel 18 between the two side panels 16 and 17, but does not extend across the full width of the front panel 14. Removal of the first access panel 31 forms a top access opening 47 that extends all of the way across the top end panel 18 and has a width W1 that is at least equal to the height dimension HC of the containers 12. Removal of the first access panel 31 leaves front retainer panel portions 37 on the front panel 14 that extend inward toward each other from the side panels 16 and 17. The width W1 of the top access opening 47 allows the container 12 to be easily removed from the carton 10 without twisting the container 12 to an angular position relative to the carton 10, or tearing the carton 10 around the top access opening 47. The opening between the front retainer panel portions 37 forms a front access opening 38 on the front panel 14 that has a width W2 that is less than the height HC of one of the containers 12 to retain the containers 12 within the carton 10 after the first access panel 31 has been removed. The second access panel 32 has a top edge 41 that defines the lower edge of the front access opening 38 and extends across less than the full width of the front panel 14.

Second, third and fourth removable tear-out access panels 32-34, respectively, are formed by weakenings 20 formed on the front panel 14 below the first tear-out access panel 31. The second, third and fourth tear-out access panels 32-34, respectively, are generally rectangular and have a width W2 that is less than the distance between the side panels 16 and 17 of the carton 10, and less than the height HC of the containers 12, so that removal of the second, third and fourth access panels 32-34, respectively, leaves a front retainer panel portion 37 on both sides of the front panel 14 of the carton 10 that are co-extensive with the front retainer panel portions 37 formed by the removal of the first tear-out access panel 31. The front retainer panel portions 37 provide structural integrity to the carton 10, and retain the containers 12 within the carton 10. It will be appreciated by those skilled in the art that more or less than four tear-out access panels may be provided on the front panel 14 depending on the number of containers 12 that are stacked within the carton 10, and depending on the height of the front panel 14 measured from the top end panel 18 to the bottom end panel 19.

FIG. 3 shows the carton 10 after the first, second, third, and fourth tear-out access panels 31-34, respectively, have been removed from the front panel 14. The lowest or fourth tear-out access panel 34 may have indicia 43 on the inside surface thereof. The indicia 43 may include, for example, a user-redeemable coupon for the purchase of goods. It is also contemplated that any or all of the access panels 31-34 may have indicia on the inside surface thereof if desired.

The bottom end panel 19 of the carton 10 may be dimensioned to fit on a door shelf of a refrigerator, and FIG. 4 shows the carton 10 positioned on a refrigerator door shelf 45. The carton 10 contains a number of containers 12A in the form of cans. The first access panel 31 has been removed allowing easy access to the containers 12A positioned at the top of the carton 10. The containers 12A are positioned within the carton 10 so that they extend height-wise between the two side panels 16 and 17. As the containers 12A are removed, the level of the containers within the carton 10 drops, and the second, third, and fourth access panels 32-34, respectively, may be removed to provide access to the lower level containers 12A. The front retainer panel portions 37 retain the containers 12A within the carton 10.

Figure 5:
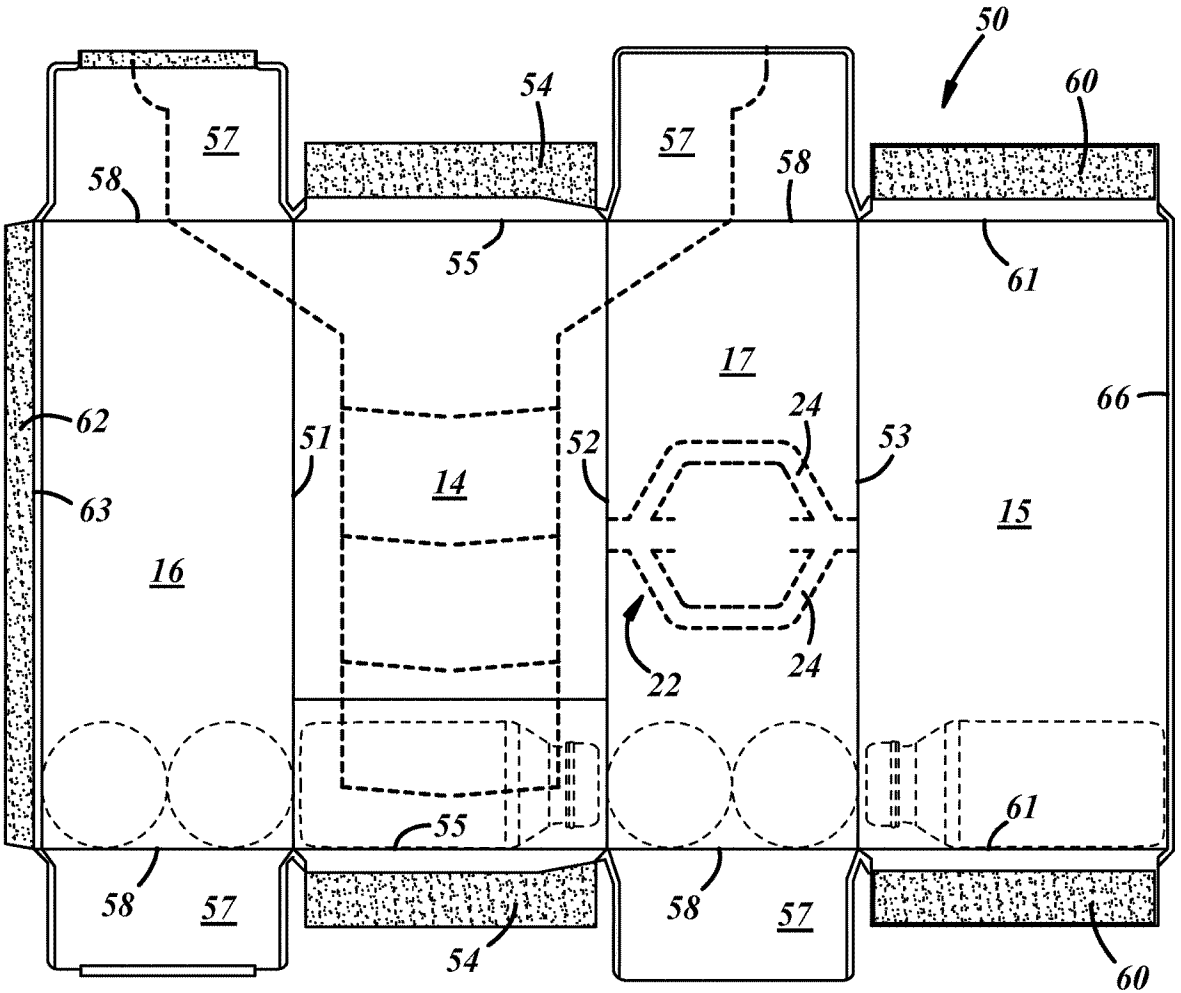
FIG. 5 shows a blank from which the dispensing carton of FIGS. 1-4 may be formed.

FIG. 5 shows a blank 50 for forming the carton of FIGS. 1-4. The front panel 14 is connected along a fold line 51 to the side panel 16 on one side and along a fold line 52 to the side panel 17 on the other side. The side panel 17 is connected along a fold line 53 to the back panel 15. Front panel end flaps 54 are connected along fold lines 55 to the ends of the top panel 14, and side panel end flaps 57 are connected along fold lines 58 to the ends of the side panels 16 and 17. Back panel end flaps 60 are connected along fold lines 61 to the ends of the back panel 15. A glue flap 62 is connected along a fold line 63 to the side of the side panel 16. The fold lines 51-53, 55,58,61, and 63 allow the adjacent panels and flaps to be folded along predetermined defined lines relative to one another during the carton formation process. When the carton is folded into its final shape, the front panel end flaps 54 are adhered to the side panel end flaps 57, and back panel end flaps 60 are adhered to the side panel end flaps 57 to form and enclose the ends of the carton 10. The glue flap 62 on the side of the side panel 16 is adhered to the side edge 66 of the back panel 15 that is opposite the fold line 53 to complete the formation of the carton 10.

There thus has been disclosed a secondary carton for beverage containers that fully satisfies one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. An enclosed carton for housing and dispensing a plurality of containers, the carton comprising:

front and back panels, side panels, and top and bottom end panels connected to said front and back panels and said side panels forming a closed structure, such that the containers are extendible height-wise between said side panels and arrangeable in at least one row between said front and back panels and stackable between said bottom and top end panels wherein the carton has a width between the side panels, a depth between the front and back panels, and a height between the top and bottom end panels, wherein the height is greater than the depth;

at least one of said side panels having at least one handle;

a plurality of access panels removably connected to said front panel and to each other via weakenings such that, with said carton positioned on said bottom end panel and the containers orientable horizontally, said access panels are separately removable in succession, from top toward bottom, to facilitate removal of the containers from the carton and render accessible remaining containers, said plurality of access panels comprising:

a first access panel including a top portion extending across a full width of the top end panel, a front portion with a lower portion extending across less than the full width of the front panel, and corner portions of the side panels, and a second access panel removably connected to said front portion of said first access panel via a weakening extending across less than the full width of the front panel, wherein said second access panel is removable in sequence after removal of said first access panel, wherein removal of the first access panel forms a top access opening extending across an entirety of the width of the carton and for less than an entirety of the depth of the carton and a front access opening on the front panel extending less than the entirety of the carton width, such that the second access panel top edge defines a lower edge of the front access opening, and wherein the side panels include end flaps having weakenings corresponding to the top access opening.

2. The carton of claim 1 further comprising:

first front retainer panel portions formed on the front panel by the removal of the first access panel, the first front retainer panel portions extending inward toward each other from the side panels and establishing first side edges of the front access opening.

3. The carton of claim 2 further comprising:

the top access opening having a width that is equal to a height of one of the containers, allowing a container to be removable from the carton through the top access opening.

4. The carton of claim 2 further comprising:

second front retainer panel portions formed on the front panel by the removal of the second access panel, the second front retainer panel portions extending inward toward each other from the side panels and establishing second side edges of the front access opening and being coextensive with the front retainer panel portions formed by the removal of the first access panel.

5. The carton of claim 4 further comprising:

a lowest access panel comprising one of the plurality of access panels, the lowest access panel being the last of a series of access panels and removable to form the front access opening and extending across less than the full width of the front panel;

lowest front retainer panel portions formed on the front panel by the removal of the lowest access panel, the lowest front retainer panel portions extending inward toward each other from the side panels, upward from the bottom end panel, and being coextensive with the first and second front retainer panel portions formed by the removal of the first and second front access panels; and, indicia on the inside surface of the lowest access panel, whereby the indicia is not visible from outside of the carton until the lowest access panel has been removed from the front panel of the carton.

6. The carton of claim 5 further comprising:

a redeemable coupon formed by the indicia on the inside surface of the lowest access panel.

7. The carton of claim 5 further comprising:

indicia on the inside surface of more than one of the plurality of access panels.

8. The carton set forth in claim 1 wherein the bottom end panel of the carton is dimensioned to be supported on a refrigerator door shelf with the bottom end panel resting on the shelf.

9. The carton of claim 1 wherein the front panel includes end flaps adhered to both of the side panel end flaps.

10. A package, including:

the carton of claim 1, and a plurality of containers having bases and sides, wherein the carton is restable in a stacking position on a side panel opposite that of the side panel having the handle such that the containers are restable upright within the carton on their bases, and wherein the carton is restable on the bottom end panel such that the containers are restable on their sides.

11. The carton of claim 1 further comprising:

a third access panel connected to the second access panel by a third weakening and to the front panel by third side weakenings, wherein said third access panel is removable in sequence after removal of said second access panel.

12. An enclosed carton for housing and dispensing a plurality of containers, the carton comprising:

front and back panels, side panels, and top and bottom end panels connected to said front and back panels and said side panels forming a closed structure, such that the containers are extendible height-wise between said side panels and arrangeable in at least one row between said front and back panels and stackable between said bottom and top end panels;

at least one of said side panels having at least one handle;

a plurality of access panels arranged one above the other on said front panel and removably connected to said front panel and to each other such that said access panels are separately removable in succession, from top toward bottom, to facilitate accessibility of the containers, said plurality of access panels comprising:

a first access panel including a top portion extending across the full width of the top end panel, a front portion with a lower portion extending across less than a full width of the front panel, and corner portions of the side panels, a second access panel connected to the first access panel via a second weakening and extending across less than the full width of the front panel and connected to the front panel by second side weakenings, wherein said second access panel is removable in sequence after removal of said first access panel, a third access panel connected to the second access panel by a third weakening and to the front panel by third side weakenings, wherein said third access panel is removable in sequence after removal of said second access panel, and a fourth access panel connected to the third access panel by a fourth weakening and to the front panel by fourth side weakenings, wherein said fourth access panel is removable in sequence after removal of said third access panel, wherein removal of the first access panel forms a top access opening extending across an entirety of the width of the carton and for less than an entirety of the depth of the carton and a front access opening on the front panel extending less than the entirety of the carton width, such that the second access panel top edge defines a lower edge of the front access opening, and wherein the side panels include end flaps having weakenings corresponding to the top access opening.

13. The carton of claim 12 further comprising:

indicia on the inside surface of at least one of the access panels, whereby the indicia is not visible until the panel is removed from the carton.

14. The carton of claim 12 wherein the front panel includes end flaps adhered to the side panel end flaps.

15. A package, including:

the carton of claim 12, and a plurality of containers having bases and sides, wherein the carton is restable in a stacking position on a side panel opposite that of the side panel having the handle such that the containers are restable upright within the carton on their bases, and wherein the carton is restable on the bottom end panel such that the containers are restable on their sides.

16. An enclosed carton for housing and dispensing a plurality of containers, the carton comprising:

a plurality of panels forming a closed structure having a depth and a height greater than the depth, and including:

a front panel, a rear panel, a bottom end panel, a top end panel, and opposed side panels between which the containers are extendible height-wise, and at least one of which has a handle;

a plurality of access panels removably connected to said front panel and to each other via weakenings such that, with said carton positioned on said bottom end panel said access panels are separately removable in succession, from top toward bottom, to facilitate removability of the containers from the carton, and including:

a first access panel including a top portion extending across a full width of the top end panel, and a front portion with a lower portion extending across less than the full width of the front panel, and a second access panel having a top edge extending across less than the full width of the front panel, wherein removal of the first access panel forms a top access opening extending across an entirety of the width of the carton and for less than an entirety of the depth of the carton and a front access opening on the front panel extending less than the entirety of the carton width, such that the second access panel top edge defines a lower edge of the front access opening, and wherein the side panels include end flaps having weakenings corresponding to the top access opening.

17. The carton of claim 16 further comprising:

first front retainer panel portions formed on the front panel by the removal of the first removable access panel, the first front retainer panel portions extending inward toward each other from the side panels and establishing first side edges of the front access opening.

18. The carton of claim 17 further comprising:

the top access opening having a width that is equal to the height of one of the containers, rendering removable a container from the carton through the top access opening.

19. The carton of claim 18 further comprising:

a second access panel comprising one of the plurality of access panels, the second access panel having a top edge that defines the lower edge of the front access opening formed by the removal of the first access panel, said second access panel extending across less than the full width of the front panel.

20. The carton of claim 16 further comprising:

a lowest access panel comprising one of the plurality of access panels; and, indicia on the inside surface of the lowest access panel, whereby the indicia is not visible from the outside of the carton until the lowest access panel has been removed from the front panel of the carton.

21. The carton of claim 20 further comprising:

a redeemable coupon formed by the indicia on the inside surface of the lowest access panel.

22. The carton of claim 16 wherein the front panel includes end flaps adhered to both of the side panel end flaps.

23. A package, including:

the carton of claim 16, and a plurality of containers having bases and sides, wherein the carton is restable in a stacking position on a side panel opposite that of the side panel having the handle such that the containers are restable upright within the carton on their bases, and wherein the carton is restable on the bottom end panel such that the containers are restable on their sides.

24. The carton of claim 16 further comprising:

a third access panel connected to the second access panel by a third weakening and to the front panel by third side weakenings, wherein said third access panel is removable in sequence after removal of said second access panel.

* * * * *